United States Patent [19]

Johnson

[11] 4,136,764

[45] Jan. 30, 1979

[54] MULTIPLE COMPARTMENT BREAD VENDING MACHINE

[76] Inventor: Alice A. Johnson, 448 Fremont Ave., Chicago, Ill. 60185

[21] Appl. No.: 744,182

[22] Filed: Feb. 2, 1977

[51] Int. Cl.[2] ..... G07F 11/62

[52] U.S. Cl. ..... 194/32; 221/281

[58] Field of Search ..... 194/2, 32, 37, 48, 51, 194/59, 65; 221/155, 281, 69, 92

[56] References Cited

U.S. PATENT DOCUMENTS

| | | | |
|---|---|---|---|
| 1,623,466 | 4/1927 | Martino et al. | 194/59 |
| 1,632,838 | 6/1927 | Higgins | 194/59 |
| 1,830,730 | 11/1931 | Worrell | 194/48 |
| 2,032,278 | 2/1936 | Graillat | 194/48 X |
| 2,052,685 | 9/1936 | Wilson | 194/65 |
| 2,258,917 | 10/1941 | Patzer et al. | 194/32 X |
| 3,329,080 | 7/1967 | Reach | 221/281 X |

*Primary Examiner*—Robert B. Reeves
*Assistant Examiner*—Francis J. Bartuska
*Attorney, Agent, or Firm*—Bernard L. Kleinke

[57] ABSTRACT

The embodiment of the invention disclosed herein is directed to a bread vending machine used for storing, displaying and selectively dispensing a plurality of packaged food articles, such as bread. The vending apparatus includes a housing structure having side, top, bottom and rear wall portions which are arranged to be constructed and assembled at a site where it is used as a floor mounting unit. The vending apparatus includes a plurality of discrete spaced apart compartments formed therein, and wherein each compartment is sized and configurated to receive packaged food articles substantially in the size and configuration of a loaf of bread. The vending apparatus further includes a corresponding plurality of discrete spaced apart hinged door members which form substantially entirely the front wall of the vending apparatus, and which door members each includes its own individual coin receiving and door lock release mechanism.

7 Claims, 4 Drawing Figures

MULTIPLE COMPARTMENT BREAD VENDING MACHINE

BACKGROUND OF THE INVENTION

1. Field of the Invention

This invention relates generally to improvements in structures and apparatus used primarily in the field of vending machines, and more particularly to devices and their combination in such structures and apparatus, that provide substantial useful improvements in existing vending machines which are commonly used in the food dispensing field. However, it will be understood that while this invention is directed particularly to devices used in the field of bread vending machines, the specific structure disclosed herein can be used in other allied fields such as vending of other large food articles, or non-food articles, and the like.

2. Description of the Prior Art

Heretofore, vending machines used in the field of dispensing relatively large packaged food articles have been relatively expensive and complicated to manufacture and/or operate over relatively long periods of time with sufficient reliability to warrant their initial cost.

Vending machines heretofore utilized primarily for large packaged food articles have been relatively complex and expensive because they usually require complicated mechanisms to actuate a food conveying apparatus within the machine to transport a particular article to be vended into close proximity to a coin release door through which the food article is removed. Such prior art vending apparatus, heretofore used, may have incorporated inclined conveying means for transporting food articles such as milk, or the like, through a single access door. This complicated structure would sometimes fail as a result of the failure of the transport mechanism and thereby cause aggravation to the prospective user thereof, firstly as a result of not obtaining the food article which is desired, and secondly as a result of losing the amount of coinage inserted into the machine.

Still another great disadvantage of prior art vending machines is that they require complicated interconnection of circuitry between the single coin receiving and release mechanism and the single door and its associated conveyor mechanism, or are used to release a single one of a plurality of such doors.

SUMMARY OF THE INVENTION

It is therefore a primary feature and advantage of the present invention to provide a vending machine for packaged food articles which overcomes the disadvantages noted above with regard to prior art vending machines or similar structures, but which vending machines retain the advantages attributed to similar predecessor structures with respect to low cost, ease of manufacture, and freedom of maintenance problems, and produce relatively reliable operation in conjunction with the capabilities of such vending machines without substantially modifying areas or floor spaces on which such vending machines are to be used.

Still another important commercial feature of the present invention is to provide a simple and unique vending machine structure which is capable of being manufactured at relatively low costs and which substantially completely performs the operations of higher priced vending machine structures.

One of the features of the present invention is the provision of a new and improved vending machine apparatus which incorporates a plurality of discrete spaced apart compartments formed in a single housing in which each compartment contains a separate packaged food article to be obtained by actuation of a discrete coin operated release mechanism associated with the compartment.

Still another feature of the present invention is the provision of a plurality of discrete spaced apart transparent doors associated with each compartment, and wherein each spaced apart transparent door collectively forms a substantial portion of the front wall of the dispensing apparatus.

Many other features and advantages of the present invention will be more fully realized and understood from the following detailed description when taken in conjunction with the accompanying drawings wherein like reference numerals throughout the various views of the drawings are intended to designate similar elements or components.

DESCRIPTION OF THE PREFERRED EMBODIMENT

Figure 1:
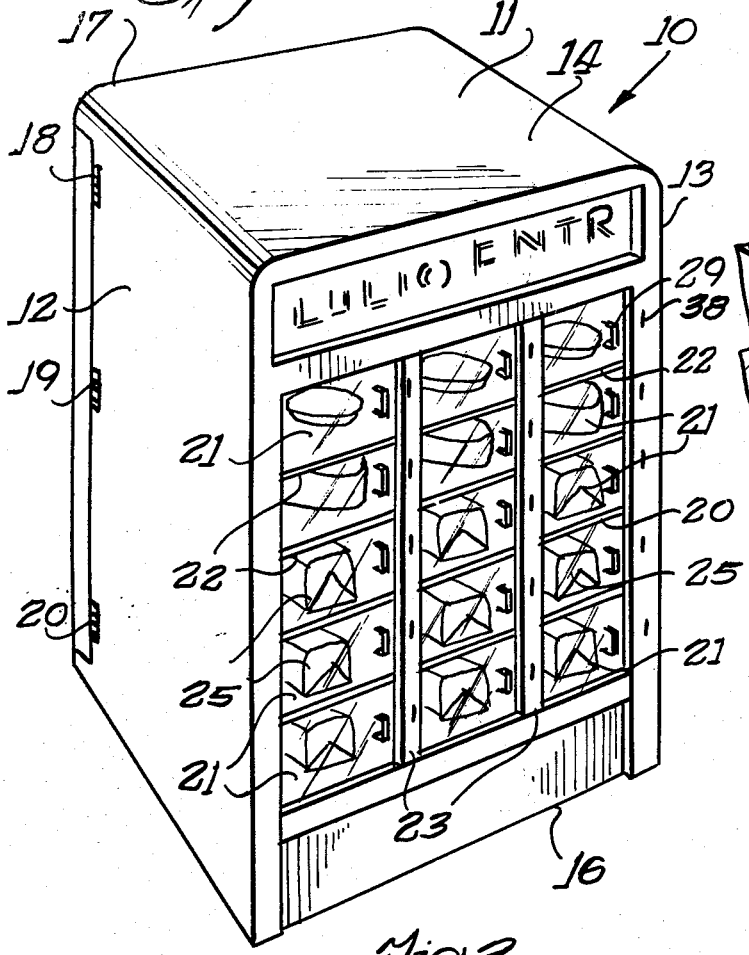
FIG. 1 is a perspective view of a vending apparatus constructed in accordance with the principles of the present invention and wherein a plurality of individual packaged food articles are selectively dispensed through discrete spaced apart compartments.
Figure 2:
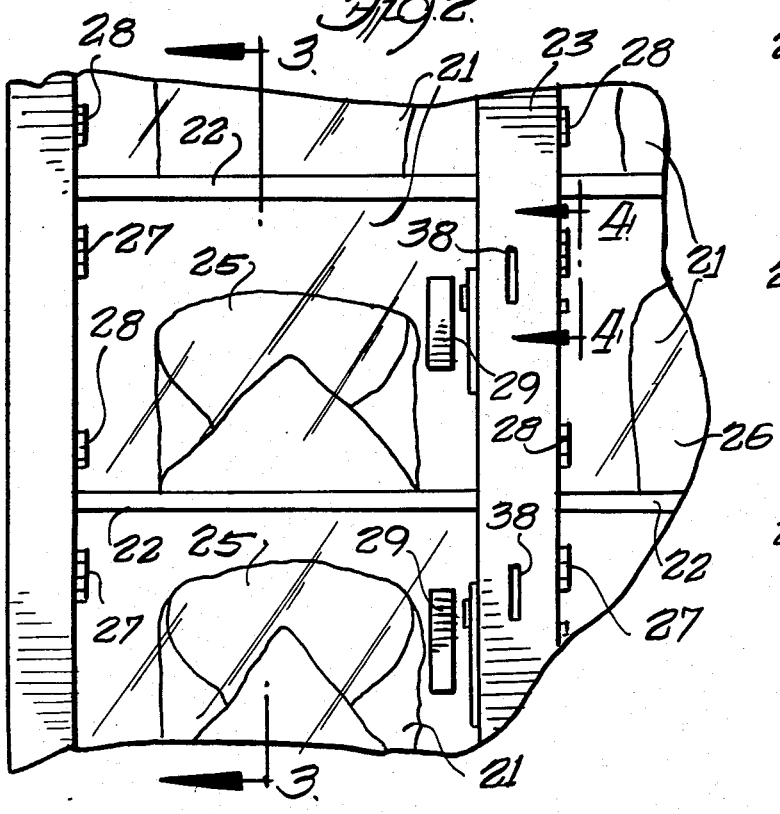
FIG. 2 is an enlarged fragmentary front view of a portion of the vending apparatus of FIG. 1, more clearly illustrating the transparent hinged door portion of each compartment and the coin receiving slot associated therewith.
Figure 3:
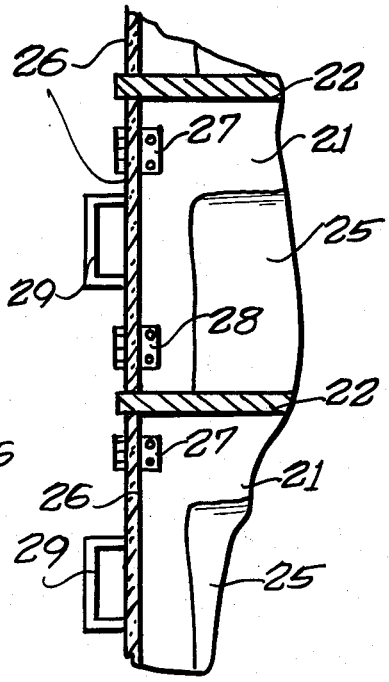
FIG. 3 is a fragmentary side sectional view taken along the line 3—3 of FIG. 2.

Referring now to FIGS. 1, 2 and 3 there is seen a vending apparatus constructed in accordance with the principles of this invention and designated generally by reference numeral 10. The coin operated vending apparatus 10 includes a housing 11 formed of a pair of spaced apart, substantially parallel and of uniform length, side walls 12 and 13 joined together by a top wall 14 and a bottom wall 16. The housing 11 further includes a rear wall 17, preferably including a plurality of vertically disposed hinge numbers 18, 19 and 20 placed along one edge thereof to allow access into the housing 11 which, in turn, allows simulteneous access to all of the compartments formed in the housing for loading of all of the compartments therein with packaged food articles.

The vending apparatus 10 preferably is designed and configurated to be constructed and assembled as a single unitary structure and delivered from the place of manufacture to the place of ultimate use as a single unit where it is placed in operation as a floor mounted structure. However, the vending machine may include some components which are assembled at the site of ultimate use.

The housing 11 includes a plurality of discrete spaced apart compartments 21 which are formed by a plurality of horizontally oriented, vertically displaced divider or wall members 22 and a plurality of vertical, horizontally displaced divider or wall members 23. In the illustrated embodiment the vertical divider or wall member is not herein particularly illustrated or described but it will be understood to be of any suitable configuration to separate the compartments 21, and which horizontal and vertical wall members may be constructed of such material as wood, plastic, metal or the like. Also it will be understood that the housing 11 preferably is constructed of heavy gage sheet metal to withstand exposure to the elements when used as an outdoor vending machine, or it may be constructed of impacked plastic, or the like.

A plurality of packaged food articles 25, such as loaves of bread or the like, are placed in the plurality of compartments 21, preferably one packaged food article per compartment, and sealed therein by an associated hinged transparent door member 26. Each of the transparent door members 26 has associated therewith, preferably on the same side of each door member, a pair of hinge units 27 and 28, they being the upper and lower hinge members, respectively. Also associated with each of the transparent door members 26 is a handle unit 29 extending forwardly thereof and positioned for easy grasping by the user of the vending machine. The handle 29 may be a discrete attached unit secured to the transparent door by screws or rivets, or the like, or it may be an integral part of the transparent door unit when made of molded material such as molded transparent plastic, or the like.

Figure 4:
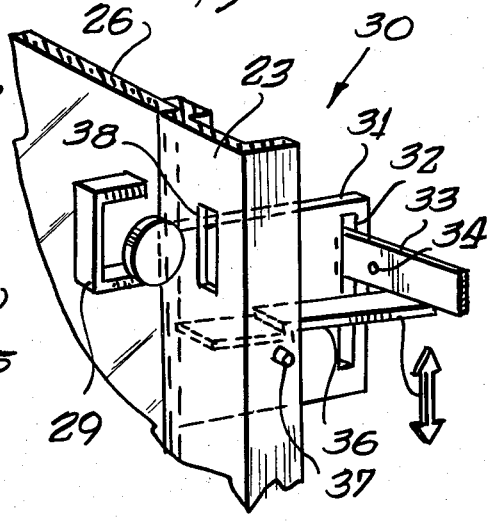
FIG. 4 is a fragmentary sectional perspective view illustrating the coin receiving and door release mechanism of the preferred embodiment of the present invention.

Referring now to FIG. 4 a detailed showing of a single one of a plurality of discrete coin receiving and door release mechanisms 30 is illustrated, it being understood that each one of the plurality of discrete coin receiving and door release mechanisms may correspond substantially to that illustrated in the Figure or each one may differ if desired. For example, certain ones of the coin receiving and door release mechanisms may be completely mechanical in operation or they may be partially mechanical and partially electrical or they may be completely electrical.

The coin receiving and door release mechanism 30 illustrated herein includes a plate member 31 associated with the transparent door 26 and which extends rearwardly of the front wall of the housing 11, and is shown in FIG. 4. A slot 32 is formed in the plate 31 and arranged to receive a transversely extended portion of an arm 33 during the locked condition of the door 26. The arm 33 pivots about a first pivot point 34 as a result of upward and downward actuation of a lever 36. The lever 36 rocks or pivots about a second pivot point 37 rearwardly of a coin receiving slot or opening 38. The coin receiving slot 38 is positioned upwardly and forwardly of the second pivot point 37 and includes means to allow the coin or coins to be inserted therein to strike upon the forward most portion of the lever 37 to rock or pivot it about the pivot point 37. This action then causes the arm 33 to pivot about the pivot point 34 and causes its transverse end thereof to become disengaged from the slot 32, which, in turn, allows the door 26 to be opened.

While a single specific embodiment of the invention has been illustrated herein in detail, it will be understood that variations and modifications thereof may be effected without departing from the spirit and scope of the novel concepts of this invention. For example, the aspects of the invention disclosed and described herein are not to be limited to the exact arrangement of parts shown in the accompanying drawings with regard to size and arrangement.

Having thus described the invention, what is claimed is:

1. A vending apparatus for storing, displaying and selectively dispensing packaged food articles therefrom, comprising in combination:

housing structure means having side, top, bottom and rear wall portions, said housing structure means arranged to be transported to the site of intended use and positioned as a floor mounted unit;

a plurality of discrete spaced-apart compartments formed in the said housing means, each compartment being a size and configuration readily to receive packaged food articles having a size and configuration substantially of that of a loaf of bread;

a corresponding plurality of discrete spaced-apart hinged door members secured to the front portion of said housing means, each hinged door member being placed in registry with a corresponding one of said plurality of compartments to allow easy access thereto when said door member is opened, said door members accumulatively being combined to form a front wall of said housing;

a corresponding plurality of discrete spaced-apart coin receiving, and door release mechanisms, associated with each one of said plurality of hinged door members to allow operation of only that door member door release mechanism which receives coins therein, to thereby permit opening of the associated door member and allow the user thereof to remove the packaged food articles from the now opened compartment;

said apparatus being substantially completely assembled prior to delivery to the intended site where it is to be used as a floor-mounted unit;

said rear wall of said housing being provided with hinge members formed along one edge thereof and being arranged to be opened to allow access to all of said compartments without opening of said plurality of said discrete spaced-apart door members from the front;

each of the said plurality of said plurality of said discrete spaced-apart hinged door members including a handle member extending outwardly therefrom to be easily grasped by the user for opening the door member after the appropriate amount of coinage has been inserted into said coin receiving and door release mechanism;

each of the said plurality of discrete spaced-apart hinged door members including a transparent portion to allow visual inspection of the packaged food article then and there contained in said compartment;

each of said plurality of discrete spaced-apart coin receiving and door releasing mechanisms including a plate, each said plate attached to one of said door members, a slot formed in said plate, an arm cooperable with said slot and pivoted at a first pivot point to selectively engage said slot during a locked condition of said door and to disengage said slot during an unlocked condition of said door, and a lever engaging said arm selectively to pivotally actuate said arm to engage and disengage said slot as a result of the absence or presence, respectively, of appropriate coinage inserted into said coin receiving and door release mechanism;

said arm being positioned and arranged relative to said lever at right angles thereto, said lever being positioned immediately adjacent a coin receiving access, and pivoted about a point rearwardly of said access to allow the weight of the coinage to actuate said lever and move said arm out of engagement of said slot; and said lever being actuated as a result of the weight of the exact coinage inserted into said coin-receiving opening.

2. The vending apparatus for storing, displaying and selectively dispensing packaged food articles constructed in accordance with claim 1 wherein said plurality of discrete spaced apart compartments are arranged in said housing in rows and columns, and wherein said hinged door members form a substantial portion of the front wall of said housing.

3. The vending apparatus for storing, displaying and selectively dispensing packaged food articles constructed in accordance with claim 1 wherein each of said plurality of discrete spaced apart hinged door members is formed substantially completely of rigid transparent material to allow visual inspection of the packaged food articles then and there contained in said compartments.

4. A vending apparatus according to claim 1, wherein each one of the plates is associated with its door and extends transversely rearwardly therefrom.

5. A vending apparatus according to claim 4, wherein each one of the first pivot points extends in a direction parallel to and spaced from the plane of its plate.

6. A vending apparatus according to claim 5, wherein the pivot point of each one of the levers extends in a direction normal to the plane of its plate in front of its arm near its door.

7. A vending apparatus according to claim 6, wherein each one of the coin receiving accesses includes means defining a slot positioned upwardly and forwardly of the lever pivot point, the forwardmost portion of each one of said levers being adapted to be struck by coins inserted through the slots to pivot the levers about their pivot points to move in turn their arms to disengage them from their plates.

* * * * *